US008726612B2

(12) United States Patent
Lomske et al.

(10) Patent No.: US 8,726,612 B2
(45) Date of Patent: May 20, 2014

(54) MODULAR PANEL

(76) Inventors: Steven G. Lomske, Northville, MI (US); Francois J. Castaing, Bloomfield Hills, MI (US)

( * ) Notice: Subject to any disclaimer, the term of this patent is extended or adjusted under 35 U.S.C. 154(b) by 868 days.

(21) Appl. No.: 12/111,262

(22) Filed: Apr. 29, 2008

(65) Prior Publication Data

US 2009/0266010 A1 Oct. 29, 2009

(51) Int. Cl.
*E04F 11/16* (2006.01)
*E04C 2/34* (2006.01)

(52) U.S. Cl.
USPC ..... 52/790.1; 52/177

(58) Field of Classification Search
USPC ..... 52/177, 181, 220.1, 263, 788.1–790.1
See application file for complete search history.

(56) References Cited

U.S. PATENT DOCUMENTS

| | | | | |
|---|---|---|---|---|
| 3,082,489 | A | 3/1963 | Douglas | |
| 3,456,411 | A | 7/1969 | Cacossa | |
| 3,504,472 | A | 4/1970 | Clement | |
| 3,696,578 | A * | 10/1972 | Swensen et al. | 52/789.1 |
| 3,723,233 | A | 3/1973 | Bourke | |
| 3,763,614 | A | 10/1973 | Hyde et al. | |
| 3,861,098 | A | 1/1975 | Schaub | |
| 3,875,719 | A | 4/1975 | Menge | |
| 3,963,846 | A | 6/1976 | Bourke | |
| 3,974,614 | A | 8/1976 | Strong | |
| 4,008,548 | A | 2/1977 | Leclerc | |
| 4,028,858 | A | 6/1977 | Rehbein | |
| 4,044,520 | A | 8/1977 | Barrows | |
| 4,059,936 | A | 11/1977 | Lukens | |
| 4,170,859 | A | 10/1979 | Counihan | |
| 4,226,064 | A | 10/1980 | Kraayenhof | |
| 4,277,923 | A * | 7/1981 | Rebentisch et al. | 52/126.6 |
| 4,279,109 | A | 7/1981 | Madl, Jr. | |
| 4,344,262 | A | 8/1982 | Berman et al. | |
| 4,361,614 | A | 11/1982 | Moffitt, Jr. | |
| 4,436,779 | A | 3/1984 | Menconi et al. | |
| 4,443,988 | A | 4/1984 | Coutu, Sr. | |
| 4,506,482 | A | 3/1985 | Pracht et al. | |
| 4,570,397 | A | 2/1986 | Creske | |

(Continued)

FOREIGN PATENT DOCUMENTS

| | | |
|---|---|---|
| CA | 989134 | 5/1976 |
| CA | 1 190 717 | 7/1985 |

(Continued)

OTHER PUBLICATIONS

Event Deck Sales and Rental Brouchure (www.eventdeck.com).

(Continued)

*Primary Examiner* — Elizabeth A Plummer
(74) *Attorney, Agent, or Firm* — Carlson, Gaskey & Olds, P.C.

(57) ABSTRACT

A modular panel, the panel comprising a first member including a top surface and a bottom surface; an optional second member joined to the bottom surface of the first member; at least two reinforcing elements integrally disposed on the bottom of the first member; at least two elements integrally disposed on the bottom surface of the first member or on the second member for affixing and/or aligning the modular panel to at least two support members, each support member including a top surface; and a support flange integrally disposed about the periphery of the first member for engaging the top surface of the support member. The modular panel being constructed of a thermoplastic material or metal.

19 Claims, 7 Drawing Sheets

(56) References Cited

U.S. PATENT DOCUMENTS

| | | | | | |
|---|---|---|---|---|---|
| 4,584,221 | A | | 4/1986 | Kiing | |
| 4,594,833 | A | | 6/1986 | Mieyal | |
| 4,628,645 | A | | 12/1986 | Tafelski, Jr. | |
| 4,658,562 | A | | 4/1987 | Brugman | |
| 4,662,972 | A | | 5/1987 | Thompson | |
| 4,664,955 | A | | 5/1987 | Clem | |
| 4,674,245 | A | | 6/1987 | Turner | |
| 4,691,484 | A | | 9/1987 | Wilson | |
| 4,712,340 | A | | 12/1987 | Sogge | |
| 4,741,138 | A | | 5/1988 | Rongoe, Jr. | |
| 4,780,571 | A | | 10/1988 | Huang | |
| 4,835,924 | A | | 6/1989 | Blacklin et al. | |
| 4,840,824 | A | | 6/1989 | Davis | |
| 4,840,825 | A | | 6/1989 | Aristodimou | |
| 4,845,908 | A | | 7/1989 | Stohs | |
| 4,860,510 | A | | 8/1989 | Kotler | |
| 4,901,490 | A | * | 2/1990 | Zinniel et al. | 52/263 |
| 4,905,431 | A | | 3/1990 | Davis | |
| 4,922,670 | A | * | 5/1990 | Naka et al. | 52/126.6 |
| 4,930,286 | A | | 6/1990 | Kotler | |
| 4,944,127 | A | | 7/1990 | Clear | |
| 4,945,697 | A | | 8/1990 | Ott et al. | |
| 4,972,537 | A | | 11/1990 | Slaw, Sr. | |
| 4,996,804 | A | | 3/1991 | Naka et al. | |
| 4,998,391 | A | | 3/1991 | Connew | |
| 5,009,045 | A | | 4/1991 | Yoder | |
| 5,048,448 | A | | 9/1991 | Yoder | |
| 5,070,664 | A | | 12/1991 | Groh et al. | |
| 5,115,621 | A | * | 5/1992 | Kobayashi | 52/792.11 |
| 5,143,418 | A | | 9/1992 | Fouquet | |
| 5,215,802 | A | | 6/1993 | Kaars Sijpesteijn | |
| 5,228,252 | A | * | 7/1993 | Nehls | 52/126.6 |
| 5,228,253 | A | | 7/1993 | Wattelez | |
| 5,311,629 | A | | 5/1994 | Smith | |
| 5,314,554 | A | | 5/1994 | Owens | |
| 5,339,581 | A | | 8/1994 | Schlickenmeyer | |
| 5,351,458 | A | | 10/1994 | Lehe | |
| 5,361,554 | A | | 11/1994 | Bryan | |
| 5,363,560 | A | | 11/1994 | Makow | |
| 5,367,853 | A | | 11/1994 | Bryan | |
| 5,394,667 | A | | 3/1995 | Nystrom | |
| 5,403,637 | A | | 4/1995 | Pickard et al. | |
| 5,406,765 | A | | 4/1995 | Brown | |
| 5,411,782 | A | | 5/1995 | Jarvis et al. | |
| 5,412,915 | A | | 5/1995 | Johnson | |
| 5,441,786 | A | | 8/1995 | Manassa | |
| 5,465,546 | A | | 11/1995 | Buse | |
| 5,487,245 | A | | 1/1996 | Dazo et al. | |
| 5,493,825 | A | | 2/1996 | Gaston | |
| 5,511,353 | A | | 4/1996 | Jones | |
| 5,527,128 | A | | 6/1996 | Rope et al. | |
| 5,613,339 | A | | 3/1997 | Pollock | |
| 5,623,803 | A | | 4/1997 | Willis | |
| 5,628,160 | A | | 5/1997 | Kung | |
| 5,632,123 | A | | 5/1997 | Erwin | |
| 5,647,184 | A | | 7/1997 | Davis | |
| 5,660,016 | A | | 8/1997 | Erwin et al. | |
| 5,749,188 | A | | 5/1998 | Belbenoit | |
| 5,758,467 | A | | 6/1998 | Snear et al. | |
| 5,761,867 | A | | 6/1998 | Carling | |
| 5,787,654 | A | | 8/1998 | Drost | |
| 5,791,096 | A | | 8/1998 | Chen | |
| 5,813,365 | A | | 9/1998 | Helmy | |
| 5,850,720 | A | | 12/1998 | Willis | |
| 5,876,084 | A | | 3/1999 | Smith et al. | |
| 5,899,029 | A | | 5/1999 | Spahr | |
| 5,930,965 | A | | 8/1999 | Carver | |
| 5,937,612 | A | * | 8/1999 | Winer et al. | 52/747.11 |
| 5,950,377 | A | | 9/1999 | Yoder | |
| 5,950,378 | A | | 9/1999 | Council et al. | |
| 5,950,389 | A | | 9/1999 | Porter | |
| 6,035,588 | A | | 3/2000 | Zehner et al. | |
| 6,044,598 | A | | 4/2000 | Elsasser et al. | |
| 6,170,105 | B1 | | 1/2001 | Doyle et al. | |
| 6,189,289 | B1 | | 2/2001 | Quaglia et al. | |
| 6,209,267 | B1 | | 4/2001 | Dantzer | |
| 6,233,886 | B1 | | 5/2001 | Andres | |
| 6,233,896 | B1 | | 5/2001 | Coup | |
| 6,247,286 | B1 | | 6/2001 | Heyns | |
| 6,286,272 | B1 | | 9/2001 | Sandoz | |
| 6,314,699 | B1 | | 11/2001 | West | |
| 6,324,796 | B1 | | 12/2001 | Heath | |
| 6,338,231 | B1 | | 1/2002 | Enriquez | |
| 6,418,690 | B1 | | 7/2002 | Wheatley et al. | |
| 6,427,395 | B1 | | 8/2002 | Elsasser et al. | |
| 6,453,632 | B1 | | 9/2002 | Huang | |
| 6,470,641 | B1 | | 10/2002 | Faure | |
| 6,558,766 | B2 | | 5/2003 | Padmanabhan et al. | |
| 6,619,002 | B2 | | 9/2003 | Pettit | |
| 6,637,161 | B1 | * | 10/2003 | Buchalter et al. | 52/126.6 |
| 6,684,582 | B2 | * | 2/2004 | Peart et al. | 52/220.1 |
| 6,804,923 | B1 | | 10/2004 | Potter | |
| 6,941,715 | B2 | | 9/2005 | Potter | |
| 6,983,570 | B2 | * | 1/2006 | Mead | 52/263 |
| 7,083,515 | B2 | * | 8/2006 | Rapisarda et al. | 454/187 |
| 7,140,156 | B1 | | 11/2006 | Lowe, Jr. et al. | |
| 2002/0026757 | A1 | | 3/2002 | Scissom et al. | |
| 2004/0003551 | A1 | | 1/2004 | Pettit | |
| 2004/0020153 | A1 | | 2/2004 | Huang | |
| 2005/0193663 | A1 | | 9/2005 | Lombardo | |
| 2006/0025512 | A1 | | 2/2006 | Potter | |
| 2006/0194034 | A1 | | 8/2006 | Kolzer | |
| 2006/0260250 | A1 | | 11/2006 | Sieg | |
| 2007/0193133 | A1 | | 8/2007 | Krupnick | |
| 2008/0141601 | A1 | * | 6/2008 | Mead | 52/263 |
| 2009/0266022 | A1 | * | 10/2009 | Lin | 52/506.1 |

FOREIGN PATENT DOCUMENTS

| | | | | |
|---|---|---|---|---|
| CA | 2 100 986 | | | 7/1993 |
| CA | 2 108 425 | | | 10/1993 |
| CA | 2471552 | | | 1/2005 |
| DE | 8517514 | | | 8/1985 |
| DE | 376373 | | | 1/1989 |
| EP | 0 053 092 | | | 10/1981 |
| EP | 0 321 749 | | | 11/1988 |
| EP | 0485297 | | | 11/1991 |
| FR | 2 349 420 | | | 4/1976 |
| JP | 07144376 | A | * | 6/1995 |
| WO | WO 2007006151 | A1 | * | 1/2007 |

OTHER PUBLICATIONS

Universal Forest Products—About Domino Modular Floor System (http://www.ufpi.com/PRODUCT/domino/about.htm—Sep. 4, 2008).

* cited by examiner

FIG - 2
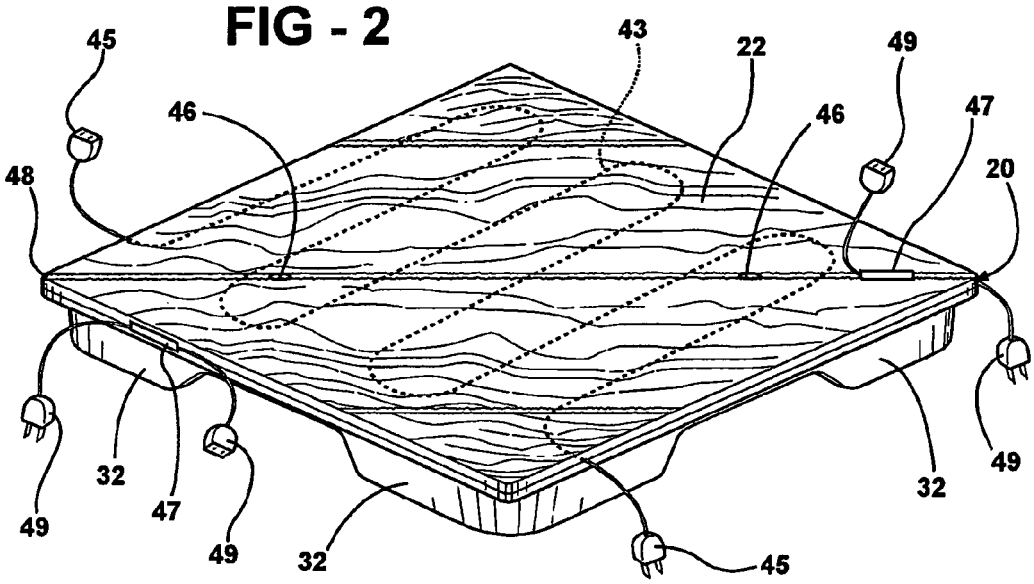
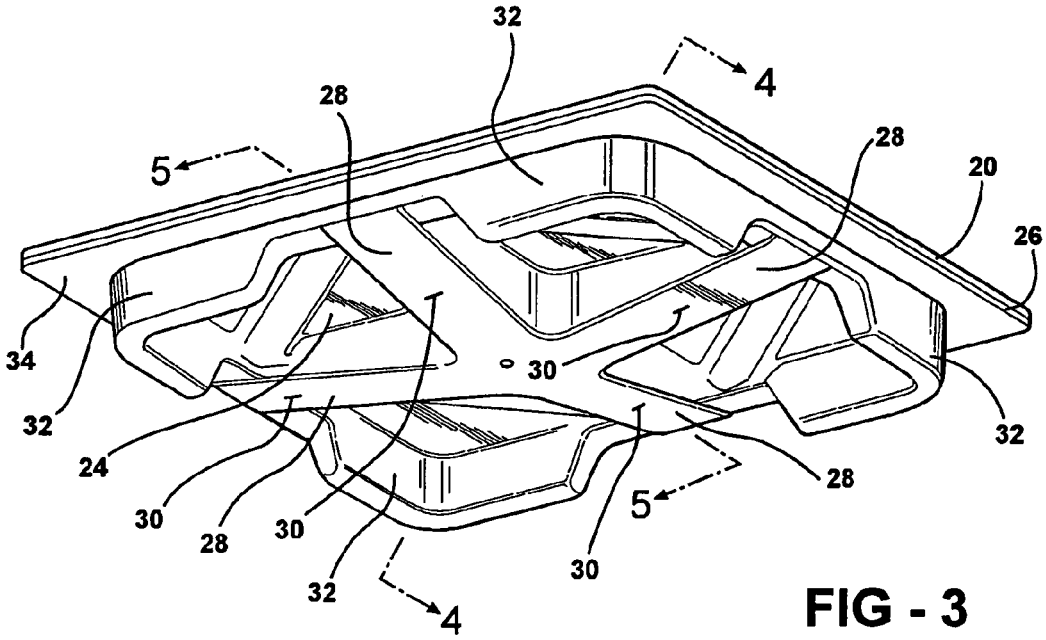
FIG - 3

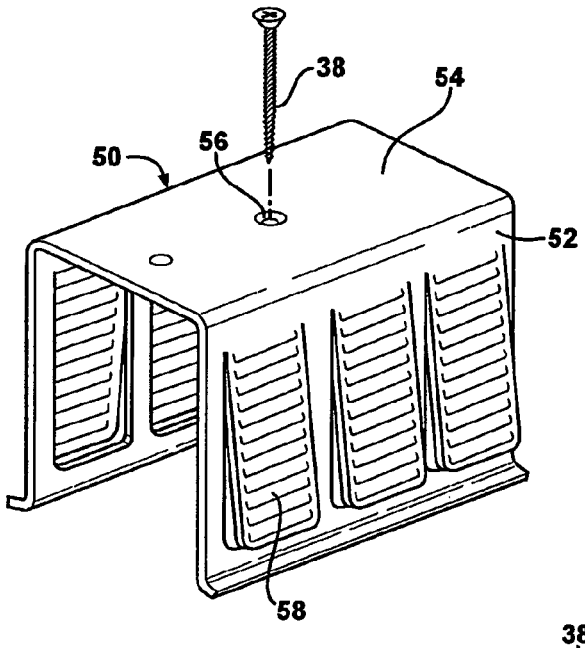
FIG - 7
FIG - 8
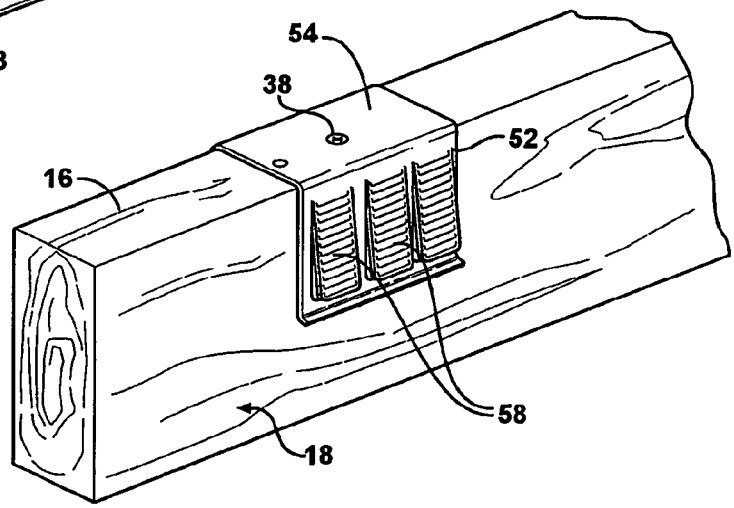
FIG - 9
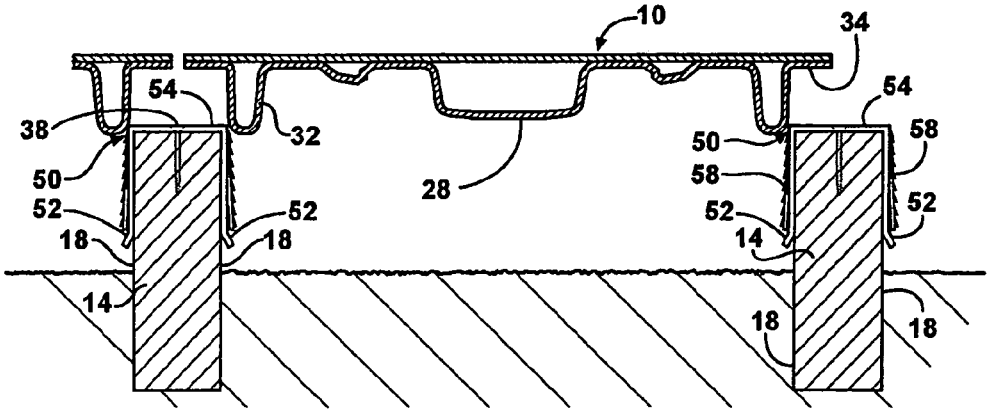

MODULAR PANEL

TECHNICAL FIELD

The subject invention generally relates to pre-fabricated deck, floor, and wall panels. More particularly, the subject invention relates to a modular deck, floor, and wall panel which can be utilized with a sub-structure for the construction of a deck or other flooring applications.

BACKGROUND OF THE INVENTION

The prevalence of exterior decks or other similar outdoor platform structures has been on the increase for a number of years. These types of structures are often utilized to provide increased usable outdoor living space for both entertainment and relaxation purposes. The complexity of exterior decks or similar structures has also increased and with that increased complexity, the cost to construct the structures has also increased.

For years, deck structures have been constructed of standard dimensional wood products such as those derived from cedar or pine. The construction of a typical deck structure includes the placement of vertical columns or posts into the ground, typically supported or anchored on a concrete pier and having a portion of the column or post extending vertically above the ground. The sub-structure also includes horizontally disposed beams which are connected to the columns or posts to support the horizontal beams above the ground, in addition, it is also common to provide a number of horizontal joists which are parallel to and uniformly spaced apart from one another and anchored to the beams. Lastly, a deck or floor surface is typically disposed perpendicularly to the joists to create a useable horizontal surface. Historically, the decking material has been common dimensional lumber such as pine. This type of decking material typically requires periodic maintenance to maintain the color and integrity of the material. For example, the periodic high pressure cleaning, bleaching, and/or application of a water resistant stain or sealant may need to be applied in order to prevent the deck from discoloring and/or degrading as a consequence of being exposed to rain, snow, sun, insects, and micro-organisms, such as fungus, mildew, and/or mold.

Alternatively, decks or similar platforms can be constructed utilizing a chemically treated wood product which inhibit the effects of water and micro-organism activity within the decking. The most common chemically treated wood product is chromated copper arsenic (CCA) or "pressure-treated" lumber in which the CCA is incorporated under pressure into the wood product by the manufacturer of the wood product prior to sale to a consumer. Use of CCA is not without issue. When CCA treated wood is cut, CCA treated particles, such as in sawdust, are released and become a health hazard working in the immediate area. Typically, those working with CCA treated lumber are advised to wear some form of respirator or mask in order to prevent the inhalation of CCA. Additionally, the chemicals used to treat these types of wood products can be absorbed through the skin, can come into contact with food products, and can leach out of the treated wood product and into the surrounding environment, such as soil, where it can present both an environmental and health hazard.

In order to overcome many of the limitations associated with wood deck materials and also to construct decks or similar wood platforms which require less maintenance or upkeep, synthetic or hybrid deck products have been developed. The most well known product of this type is sold under the trademark TREX®. This product is made from a combination of reclaimed wood and plastic that is manufactured to give the appearance of traditional wood decking. However, in addition to being expensive, it is thought by many to have an unnatural appearance. Also, because of the properties of the product itself, i.e., its high density, this type of product is heavy which makes it both difficult to handle and also expensive to transport adding to the high price of the product.

Another disadvantage associated with traditional deck and platform structures results from the labor associated with applying narrow strips of deck material to cover large areas of the sub-structure supporting the deck or platform. Modular deck systems are well-known in the art. These systems are typically prefabricated wood panels which are affixed to a sub-structure to create a deck. Often, these prefabricated panels are constructed having individual boards secured together to form a single panel. These larger prefabricated panels can be affixed to a substructure much more quickly and with less labor requirements than is required for constructing a similarly sized traditional deck. U.S. Pat. No. 6,804,923 discloses a prefabricated modular deck system which is representative of the state of the prior art. These types of prefabricated panels are, in and of themselves, labor intensive and costly to construct as the individual decking boards must still be attached to form the modular member often requiring the use of fasteners, clips, or other elaborate methods of fixation. Additionally, prefabricated panels constructed in this manner are often heavy, making them difficult to handle and expensive to transport.

Accordingly, it would be desirable and advantageous to have a prefabricated decking panel which is resistant to the elements, is a low cost alternative for traditional or synthetic decking materials, is easily attached to support structures, is low maintenance, easy to install, and is lightweight making it both easy to handle and to transport.

SUMMARY OF THE INVENTION

A modular panel is disclosed. The panel comprises a first member including a top surface and a bottom surface; an optional second member joined to the bottom surface of the first member; at least two reinforcing elements integrally disposed on the bottom surface of the first member or on the second member; at least two elements integrally disposed on the second member for affixing and/or aligning the modular panel to at least two support members, each support member including a top surface; and a support flange integrally disposed about the periphery of the first member for engaging the top surface of the support member.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2 is a perspective view showing the top surface of the modular panel according to the present invention;

FIG. 3 is a perspective view illustrating the underside of the modular panel according to the present invention;

FIG. 7 is a perspective view of a fixation clip according to the present invention;

FIG. 8 is a perspective view showing a fixation clip dispersed on a support joist;

FIG. 9 is a cross-sectional view showing deck panels of the present invention utilizing fixation clips;

DETAILED DESCRIPTION OF THE INVENTION

Figure 1:
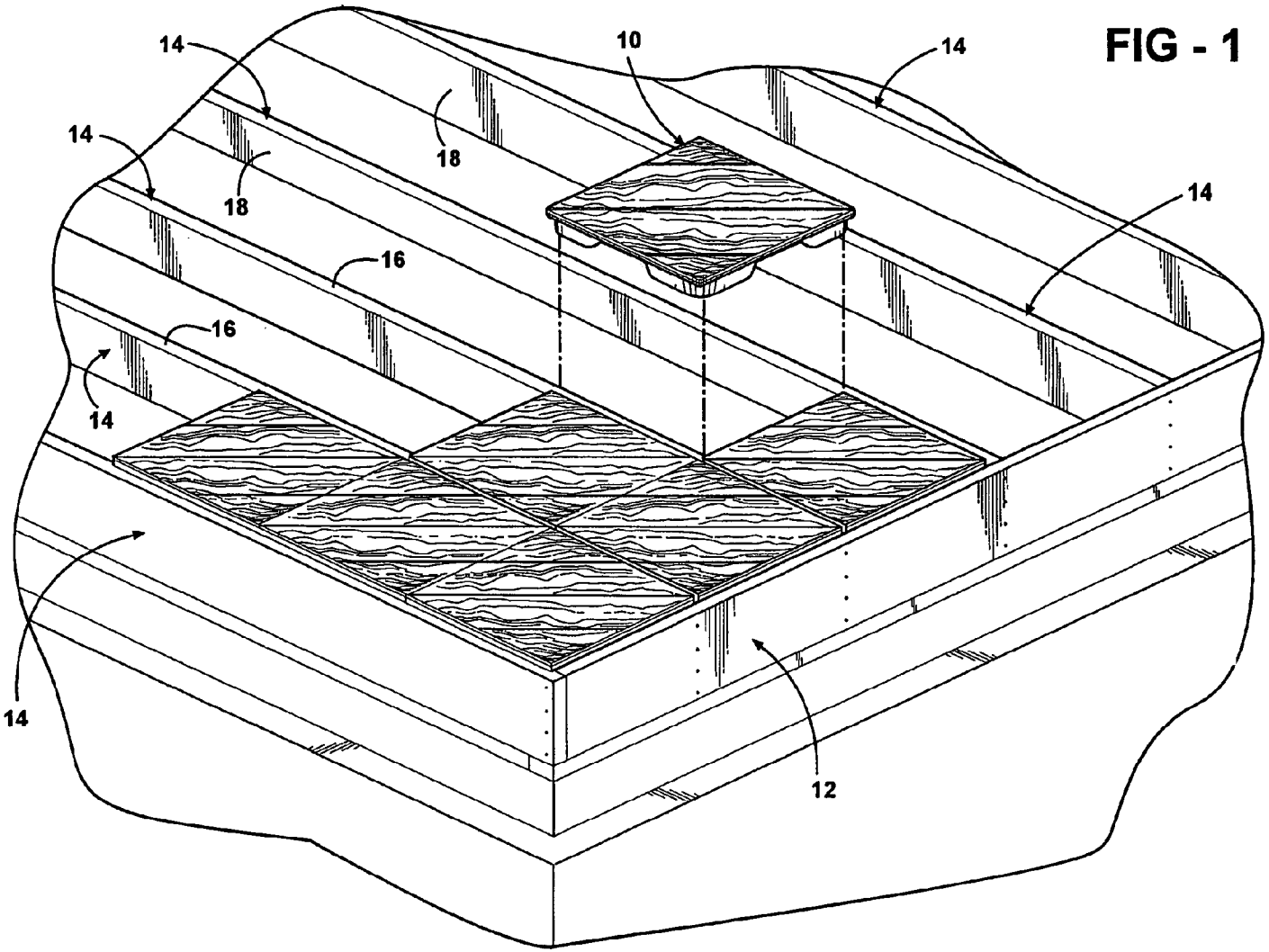
FIG. 1 is a perspective view of a deck structure utilizing the modular panel according to the present invention.

Referring to FIG. 1, a first embodiment of a modular panel 10 is shown mounted to a sub-structure 12 generally composed of parallel joists 14 which can be wood or metal having a top 16 and two sides 18. A plurality of modular panels 10 disposed in cooperating relationship to one another form a contiguous deck surface as shown in FIG. 1.

Referring now to FIGS. 2 and 3, each modular panel 10 includes a first or top panel member 20 having a top surface 22 and a bottom surface 24. A second or bottom panel member 26 is affixed to the bottom surface 24 of the first panel member 20 and includes integrally disposed reinforcing elements or beams 28. Each reinforcing element 28 includes a bottom surface 30. The second panel member 26 also includes integrally disposed element or lug 32 for affixing and/or aligning the modular panel 10 to the sub-structure 12, preferably to at least two parallel and adjacent joists 14. The first panel member 20 also includes an integral support flange 34 disposed substantially about the periphery of the first panel member 20 for engaging the top 16 of the support member or joist 14. The support flange 34 extends laterally away from the element or lug 32 allowing the fixation element 32 to engage the sub-structure 12 and so that the support flange 34 can engage the top 16 of the support structure or joist 14.

Figure 4:
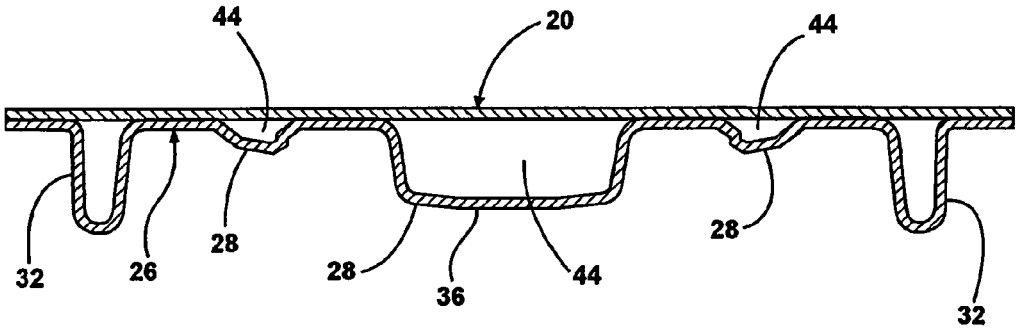
FIG. 4 is a cross-sectional view of the modular panel according to the present invention taken along line 4-4 of FIG. 3.

The element or lug 32 can include at least two and preferably four discrete fixation elements 32 disposed at desired portions on the second panel 26 member such as at its corners (as shown in FIGS. 2 and 3), or it can be substantially continuously disposed about the periphery of the second panel member 26 to allow the modular panel 10 to be affixed at any point thereon. Referring specifically to FIG. 4, at least a portion of each element or lug 32 extends substantially below the bottom surface 36 of each reinforcing element 28 to allow sufficient clearance for the insertion of a fastener 38, such as a screw, nail, or staple, through the element or lug 32 and into the sub-structure 12 or support member or joist 14. A portion of the element or lug 32 is dropped or extends below the bottom surface 36 of the reinforcing element 28 to provide sufficient clearance for a device 40, such as a drill, a pneumatic nail/staple gun, to be inserted from the underside of the second panel member 26 to drive or affix the fastener 38 through the element or lug 32 and into the sub-structure 12 or support member (e.g. joist) 14. Alternatively, each panel 10 can be affixed to sub-structure 12 by disposing the fastener 38 through both the top 20 and bottom 26 panel members and into the sub-structure 12 or the panel 10 can be glued to the sub-structure 12.

Alternatively, other type of fasteners can be utilized such as a clip 50 as shown in FIGS. 7, 8, and 9. Referring specifically to FIGS. 7, 8, and 9, the clip 50 is shown as a mechanism for affixing the panel assembly 10 to the sub-structure 12 or joist 14. The clip 50 includes two side members 52 for engaging the sides 18 of the joist 14 and a top member 54 for engaging the top surface 16 of the joist 14. The top member 54 also can include at least one aperture 56 for a fastener 38, such as a screw or nail, to be inserted therethrough to affix the clip 50 to the sub-structure 12 or joist 14.

The side member 52 also includes a plurality of resilient retention fingers 58 which, upon contact with a panel assembly 10 during installation thereof, are resiliency deflected away from the element or lug 32 when engaged by the fixation element 32 and the retention fingers 58 move back toward their original position to resiliently engage and retain the panel assembly 10 to the substructure 12 or joist 14. The clips 50 retain the panels 10 by physically engaging the panels 10 and retaining the panels 10 in between adjacent joists 14 as shown in FIG. 9.

The retention fingers 58 are disposed in such a manner that upon engagement with the panel assembly 10, each finger 58 can be biased away from the element or lug 32 to allow for the panel assembly 10 to be inserted between adjacent joists 14 and, at the same time, remain in contact with the element or lug 32 to secure the panel assembly 10 to the substructure 12 or joist 14.

Further, the retention fingers 58 are disposed in an orientation which allows the panel assembly 10 to be easily inserted in between two adjacent joists 14, this orientation also prevents the panel assembly 10 from being removed upon the application of a force in the direction opposite to the direction of insertion.

The clips 50 can be made of any material suitable for providing the resilient properties described above. Preferably, the clip 50 can be constructed from a non-corrosive metal such as stainless steel or other corrosion resistant materials such as zinc-treated steel. Also, the clip 50 can be made of plastic materials including polypropylene.

Each fixation element or lug 13 is preferably disposed so that it contacts adjacent support members hoists) 16 of the sub-structure 12 to allow for both fixation of the modular panel 10, to align the modular panel 10 between adjacent joists 14 of the sub-structure 12, and to provide uniform spacing between adjacent panels 10 further facilitating the rapid installation of the modular panels 10 and enhancing the strength and integrity of the entire deck assembly.

Referring to FIG. 2, the top surface 22 of the modular panel 10 can be textured or embossed to simulate a traditional deck having a plurality of planks disposed parallel to one another having gaps 48 between each plank. The top surface 22 can also be textured in a variety of designs or patterns to simulate, for example, bricks, tiles, imitation stone, or any desired texture or pattern. The top surface 22 can also be textured to provide a non-slip surface.

Figure 6:
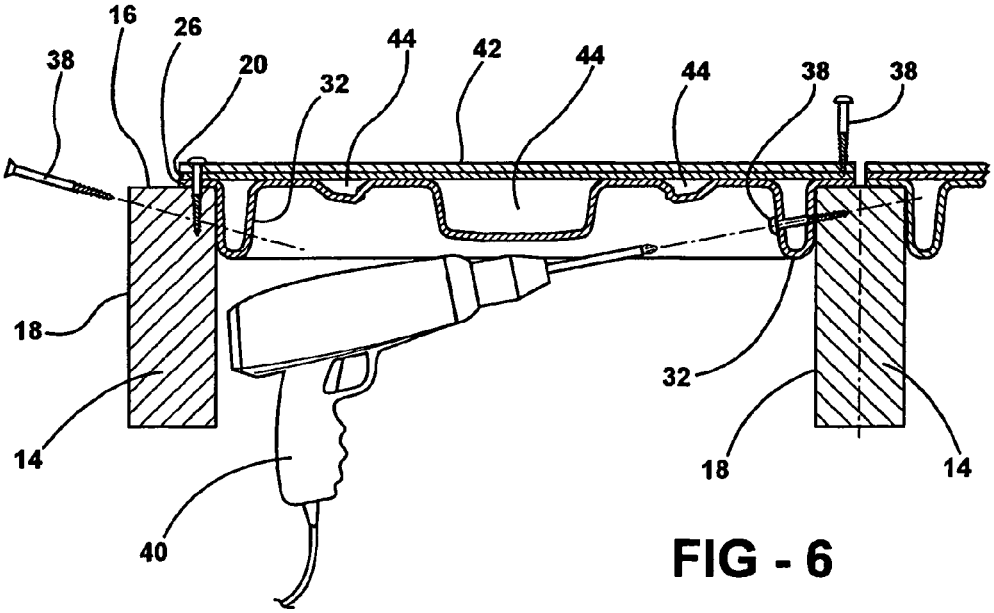
FIG. 6 is a cross-sectional view of the modular panel according to the present invention disposed between two support joists.
Figure 10:
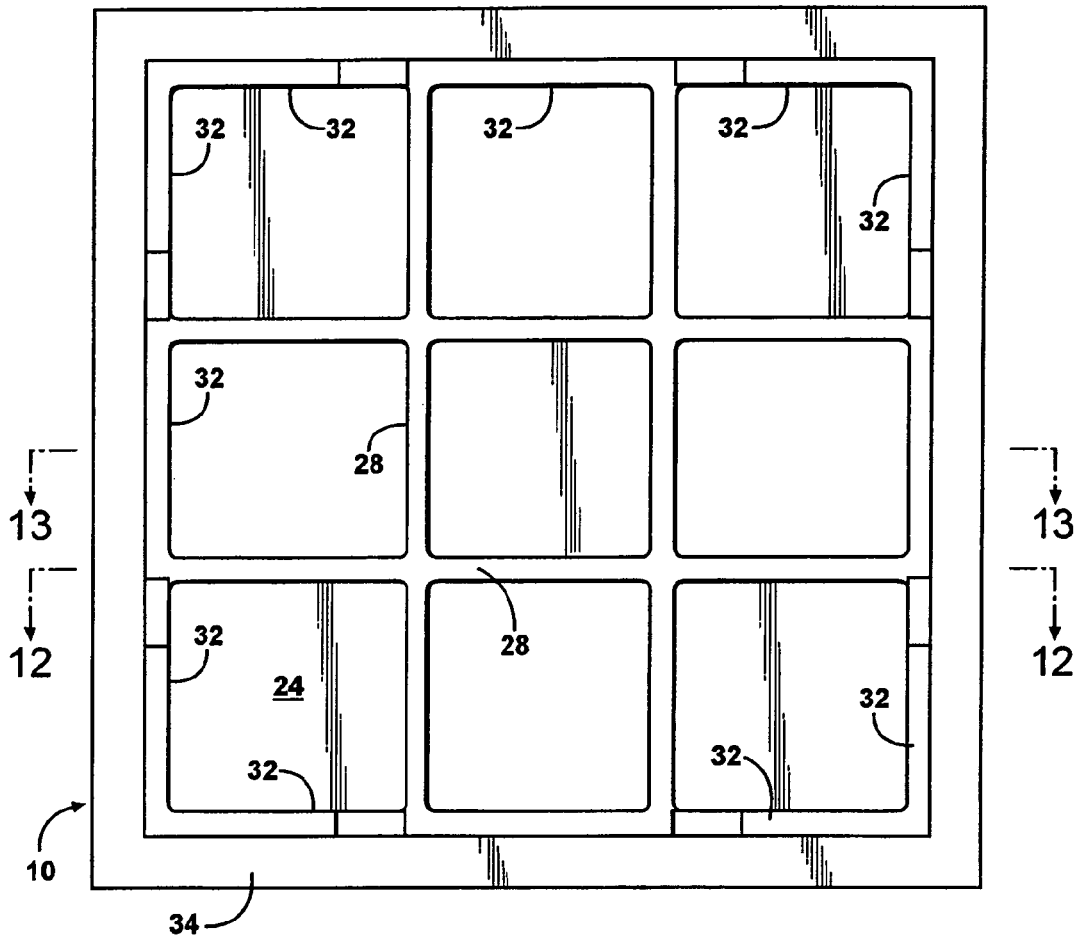
FIG. 10 is a bottom view of an injection molded panel according to the present 10 invention.

Referring to FIG. 6, an additional layer 42 can be disposed over the top surface 22 of the modular panel to impart additional properties or characteristics to the modular panel 10. This additional layer 42 can be a resilient material which provides cushioning, a non-slip surface, an anti-static layer, provide ultra-violet inhibition, enhances the texturing or graining effects, or a combination thereof. The anti-static layer may be utilized in applications, such as when the modular panel will be used in an environment where one would want to prevent the buildup of static electricity, such as where flammable vapors or fumes are present, for example, in the presence of gasoline. In addition, a fluorescing agent, such as fluoroscein and other well known fluorescing agents or glow-in-the-dark agents, can also be associated with the additional layer 42 to emit a low glow or provide illumination at night and to enhance the safety of the modular panel 10. The properties or characteristics associated with the additional layer 42 can also be provided to the top surface 22 by, for example, adding an anti-slip friction enhancing material, fluorescing agent, and/or an anti-static material directly to the material used to form the modular panel 10 thereby obviating the need for layer 42. In this use, the additional layer 42 may still be utilized to impart further properties or characteristics to the modular panel 10.

The additional layer 42 can be a separate layer or sheet applied to the top panel member or can be applied by spraying, lamination, or by other known means for applying a layer having the desired properties to the top surface 22 of the first panel member 20.

The modular panel assembly 10 can further include a heating element 43 disposed between either the first panel member 20 and the second panel member 26, as shown in FIG. 2, or disposed between the first panel member 20 and the additional layer 42. The heating element 43 can include an electric radiant mat or fabric that can be placed in between the desired layers during the molding process. Electrical connectors 45 are provided to connect adjacent panels 10. The modular assembly 10 can also include at least one lighting element 47. The lighting element 47 can be embedded into the modular panel assembly 10 during molding of the panel assembly 10 or can be affixed by well known means after molding of the panel assembly 10, both shown in FIG. 2. The lighting element 47 can be disposed within gaps 48 as shown in FIG. 2. The lighting element 47 is provided with electrical connector 49 to electrically connect adjacent panels 10. The lighting element 47 can include any suitable light source, such as LED or the like. The lighting element 47 can be disposed within the gap 48 or can be disposed about the perimeter of the panel assembly 10 as shown in FIG. 2.

Figure 5:
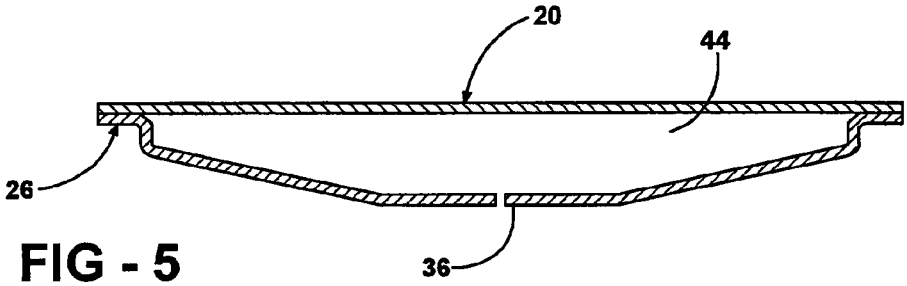
FIG. 5 is a cross-sectional view of the modular panel according to the present invention taken along 5-5 of FIG. 3.

Referring to FIGS. 4 and 5, each reinforcing element or lug 28 is integrally disposed within the second panel member 26 to provide structural support and rigidity to the modular panel 10. As formed, each reinforcing element 28 includes a hollow or empty interior cavity 44. This cavity or empty space 44 can be filled with a material, such as an expandable foam material, including polyurethane, polystyrene, or polyisocyanurate, in order to improve both the thermal (insulative) and/or structural properties (rigidity) of the modular panel 10.

As described above, each modular panel 10 can be formed of a first or top panel member 20 and a second bottom panel member 26. The top panel member 20 and the bottom panel member 26 can be constructed of thermoplastic material suitable for thermoforming or a metal material suitable for stamping and welding. The material can include thermoplastic olefin, polyethylene, polypropylene, combinations thereof, aluminum steel, galvanized steel, or other suitable alloys. The material can also include additional components such as a reinforcing material, anti-static material, anti-slip material, etc. The reinforcing material can include reinforcing fibers such as fiberglass which is mixed into the material prior to the thermoforming process. The anti-static material can include carbon black or other static dissipating material.

For making thermoformed panel 10, virgin material can be utilized to construct either the top panel member 20 or the bottom panel member 26. Recycled material can also be used to make either the top panel member 20 or the bottom panel member 26. Each panel 10 is preferably formed using well known thermoforming technology the form and combine the top 20 and bottom 26 panel members As stated above, the panels 10 can also be made by conventional metal stamping/forming techniques. The top 20 and bottom 26 panel members can be formed and then welded to combine them together using well known methods.

Referring to FIG. 1, apertures or slots 46 can be disposed throughout the panel 10 and extend completely therethrough in order to allow for the drainage of water or other fluids. In one embodiment, the apertures or slots 46 are disposed in the gap 48 which are provided to simulate wood planks or strips.

Alternatively, the panel assembly 10 having similar element to that described above for the thermoformed embodiment, can be constructed by injection molding using techniques well known to those in the art. Identical reference numerals are used for elements which are equivalent between the thermoformed embodiment and the injection molded embodiment. Referring to FIGS. 10,11, 12, and 13, the panel assembly 10 made by injection molding is shown. The panel assembly 10 includes a top surface 22, and a bottom surface 24, reinforcing beams 28, a element or lug 32, and a support flange 34. The panel assembly 10 can be utilized and affixed to the sub-structure 12 in the same manner as for the thermoformed embodiment described above. Further, the injection molded panel can also include all suitable additional features disclosed herein including the additional layer 42 as described above.

The modular panels 10 of the present invention can be utilized as a decking material in applications including, but not limited to, walkways, decks, boardwalks, docks, industrial/agricultural floors, and the like. That is, the modular panels 10 of the present invention can be utilized as a decking material in any application where a suitable sub-structure 12 or support (joist) 14 is provided or can be applied over wood or metal furring strips supported on a suitably compacted soil, sand, or slag base, or a concrete base as shown in FIG. 9. Also, because a structure constructed using the panels 10 of the present invention can be easily disassembled, use of the panels 10 for constructing temporary structures such as walkways or flooring is ideal. Also, because the panels 10 are made of non-absorbent material, the panels 10 can be cleaned and reused. The panels 10 can be fabricated into small individual units or as larger units depending on the desired application or use.

Figure 15:
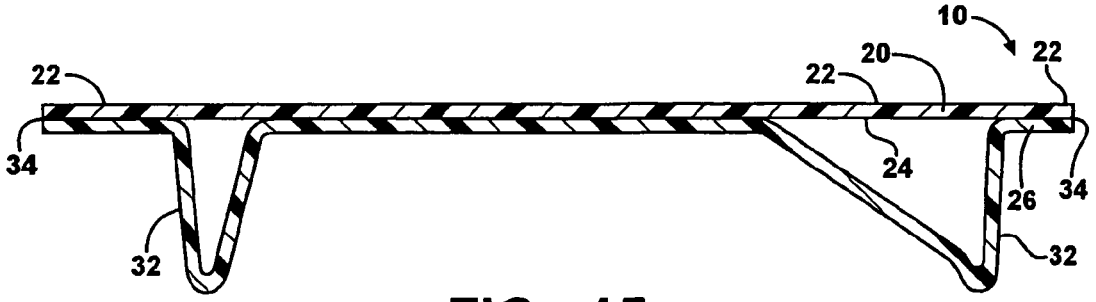
FIG. 15 is a cross-sectional view of the fractional deck panel taken along lines 15-15 of FIG. 14.
Figure 11:
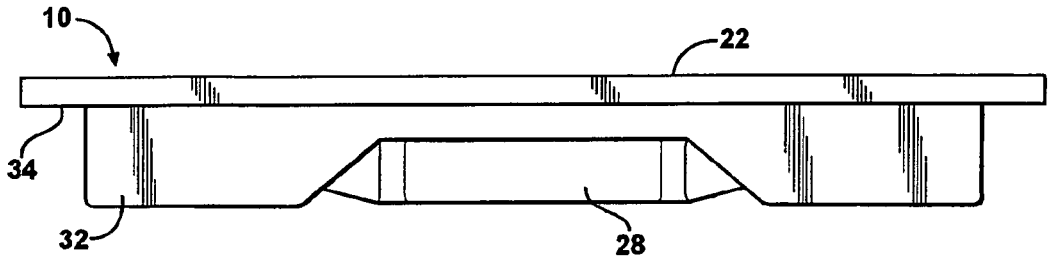
FIG. 11 is an end view of the injection molded panel of FIG. 10.
Figure 12:
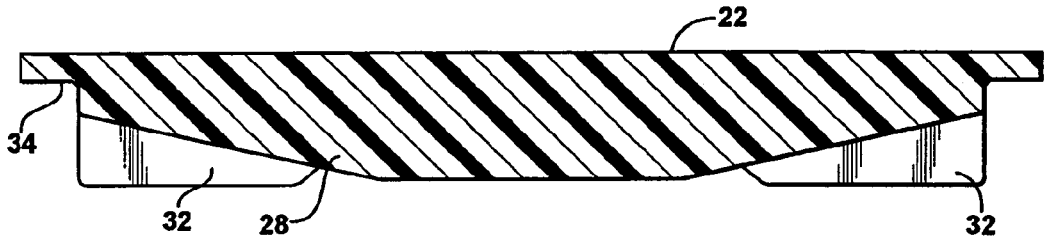
FIG. 12 is a cross-sectional view of the injection molded panel taken along lines 12-12 of FIG. 10.
Figure 13:
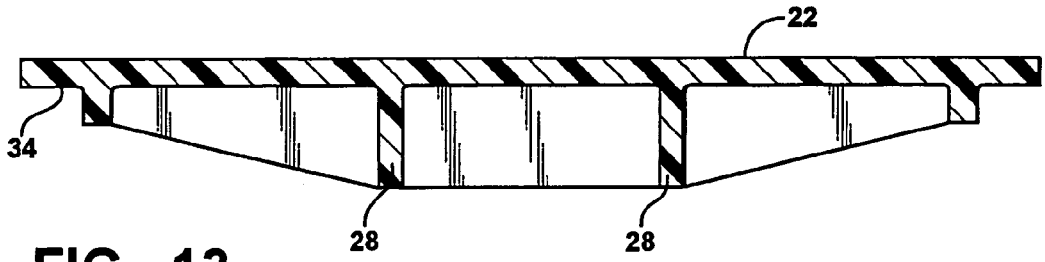
FIG. 13 is a cross-sectional view of the injection molded panel taken along line 13-13 of FIG. 10.
Figure 14:
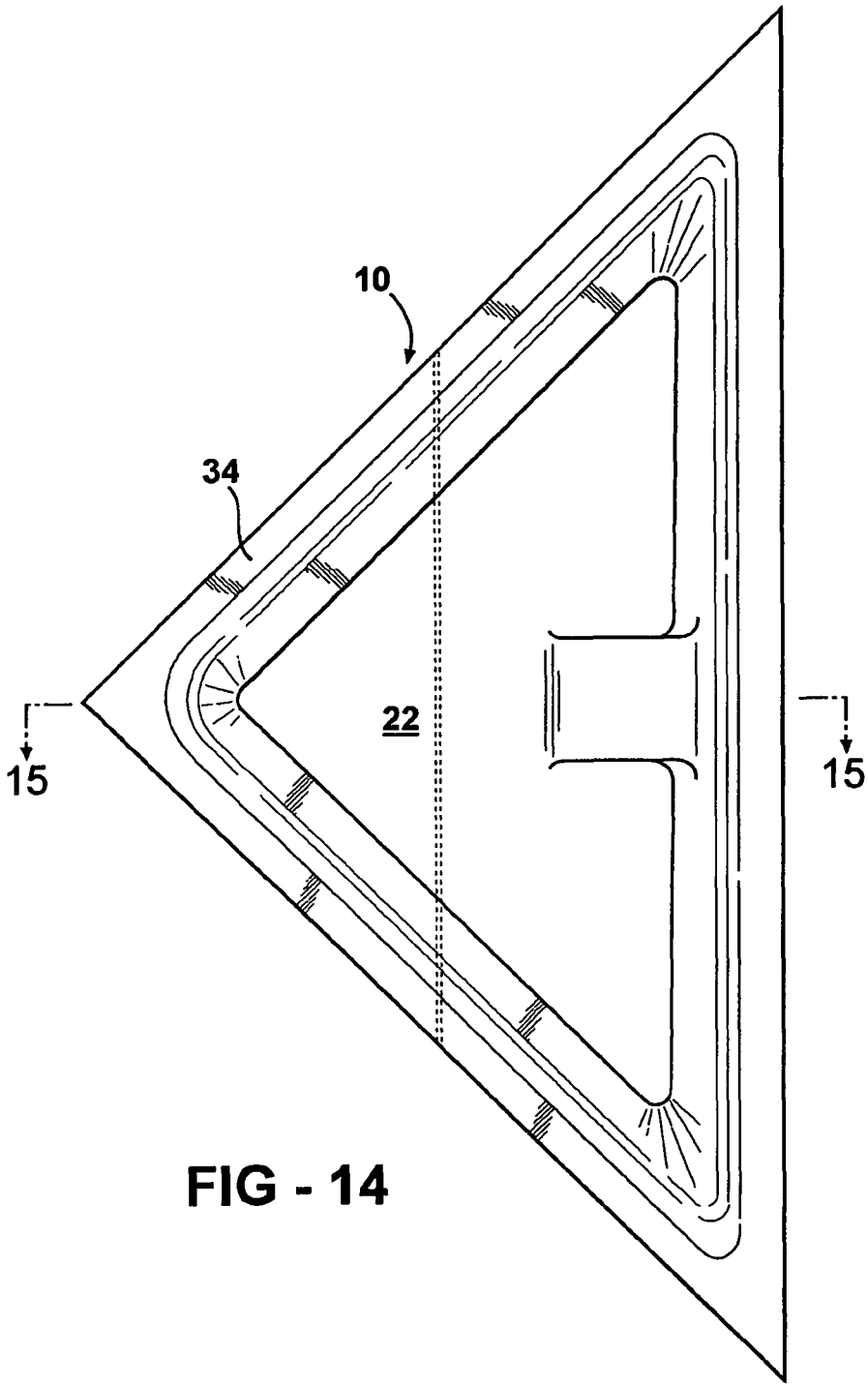
FIG. 14 is a top view of a fractional deck panel according to the present invention.

Additionally, as shown in FIGS. 14 and 15 a fractional panel or corner panel is also provided which can be utilized for applications where a full panel would not be desirable such as to fill in a corner or to accommodate unique angles, etc. where a full panel assembly 10 is not necessary or capable of filing the space.

The thermoformed modular panels 10 according to the present invention are lightweight and can be stacked or nested for storage and/or transportation. Since the modular panels 10 are lightweight, they are easy to handle and economical to transport.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed:

1. An outdoor modular panel for creating an outdoor walk, deck or dock, said modular panel comprising:

a first member including a top surface, a bottom surface and an outer periphery;

a one-piece homogenous second member integrally attaching to said bottom surface adjacent to said outer periphery wherein said first member and said one-piece homogenous second member form a hollow area therebetween, said second member having, at least two reinforcing elements disposed below said bottom surface of said first member;

at least two fixation elements disposed below said outer periphery of said first member and having an extended portion that extends below each reinforcing element, said extended portion configured to attach directly without any intervening part to a side portion of a joist, each of said fixation elements configured to laterally affix and align said modular panel to said side portion of said joist; and a support flange integrally disposed about said outer periphery of said first member for engaging a top portion of said joist.

2. An outdoor modular panel for creating an outdoor walk, deck or dock, said modular panel comprising:

a first member including a top surface, a bottom surface and an outer periphery;

a second member integrally attaching to said bottom surface of said first member wherein said first member and said second member form a hollow area therebetween, said second member having;

at least two reinforcing elements disposed below said bottom surface of said first member;

at least two fixation elements for aligning and affixing to and directly contacting a joist, said fixation elements extending substantially about a periphery of said outer periphery and disposed below said outer periphery of said first member and having an extended portion that extends below said reinforcing elements, said extended portion configured to laterally attach to a side portion of said joist, and, a support flange integrally disposed about said outer periphery of said first member and engaging a top portion of said joist.

3. An outdoor modular panel according to claim 2, wherein each fixation element substantially extends about said periphery of said second member.

4. An outdoor modular panel according to claim 3, wherein said portion of each fixation element extending substantially below each reinforcing element includes an aperture for receiving a fastener therethrough for affixing said modular panel to said side of said joist.

5. An outdoor modular panel according to claim 3, wherein said top surface of said first member has a texture.

6. An outdoor modular panel according to claim 5, wherein said texture simulates wood grain.

7. An outdoor modular panel according to claim 3, wherein said texture provides a non-slip surface.

8. An outdoor modular panel according to claim 2 further comprising an additional layer disposed on said top surface of said first member.

9. An outdoor modular panel according to claim 8, wherein said additional layer comprises a resilient layer.

10. An outdoor modular panel according to claim 8, wherein said resilient layer provides a non-slip surface.

11. An outdoor modular panel according to claim 8, wherein said additional layer comprises an anti-static layer.

12. An outdoor modular panel according to claim 2, wherein each reinforcing element is filled with foam.

13. An outdoor modular panel according to claim 2, wherein said first member and said second member are constructed of a material selected from a thermoplastic olefin, polyethylene, polypropylene, or combinations thereof.

14. An outdoor modular panel according to claim 13, wherein said material further comprises a reinforcing material.

15. An outdoor modular panel according to claim 2, wherein each of said at least two fixation elements abut a support member to align said modular panel between adjacent support members.

16. An outdoor modular panel according to claim 2 including at least one aperture extending through said first member and said second member for draining water from said top surface.

17. An outdoor modular panel according to claim 16, wherein said aperture is a slot.

18. The outdoor modular panel of claim 2 further comprising a heating element disposed between the first member and the second member.

19. A method for creating an outdoor walk, deck or dock having joists, each joist having a top portion and a side portion, said method comprising:

providing a first member including a top surface, a bottom surface, an outer periphery and a support flange integrally disposed about said outer periphery of said first member;

attaching a one piece second member integrally to said bottom surface of said first member wherein said first member and said one-piece second member form a hollow area therebetween, said second member having;

at least two reinforcing elements disposed below said bottom surface of said first member;

at least two fixation elements, said fixation elements disposed below said outer periphery of said first member and having an extended portion that extends below said reinforcing elements said extending portion contacting said joist directly without any portion in between said joist and extended portion, and resting said support flange upon said top portion of said joists outdoors, said fixation elements aligning said first and second members relative to said joists, and driving an attachment laterally through said extended portion of said fixation element outdoors into said joist to secure said first and second portions to said joist.

* * * * *

UNITED STATES PATENT AND TRADEMARK OFFICE

CERTIFICATE OF CORRECTION

PATENT NO. : 8,726,612 B2
APPLICATION NO. : 12/111262
DATED : May 20, 2014
INVENTOR(S) : Steven G. Lomske It is certified that error appears in the above-identified patent and that said Letters Patent is hereby corrected as shown below:

IN THE CLAIMS:

In claim 7, column 7, line 57; remove “3” and replace with --5--

In claim 10, column 8, line 6; remove “8” and replace with --9--

Signed and Sealed this
Sixth Day of January, 2015

Michelle K. Lee

Michelle K. Lee
*Deputy Director of the United States Patent and Trademark Office*